US008442257B2

(12) United States Patent
Aase et al.

(10) Patent No.: US 8,442,257 B2
(45) Date of Patent: May 14, 2013

(54) CABLES WITH INTERTWINED JACKETS

(75) Inventors: Jonathan S. Aase, San Francisco, CA (US); Douglas Weber, Arcadia, CA (US)

(73) Assignee: Apple Inc., Cupertino, CA (US)

( * ) Notice: Subject to any disclaimer, the term of this patent is extended or adjusted under 35 U.S.C. 154(b) by 247 days.

(21) Appl. No.: 12/892,292

(22) Filed: Sep. 28, 2010

(65) Prior Publication Data

US 2012/0076318 A1 Mar. 29, 2012

(51) Int. Cl.
*H04R 25/00* (2006.01)

(52) U.S. Cl.
USPC ..... 381/370; 381/374

(58) Field of Classification Search ..... 381/370, 381/374, 377, 378; 174/110 R, 120 R, 121 R, 174/122 R, 137 R
See application file for complete search history.

(56) References Cited

U.S. PATENT DOCUMENTS 1,523,051 A * 1/1925 Carpenter et al. ..... 174/124 R
2,277,177 A * 3/1942 Wermine ..... 174/121 R
2,911,328 A * 11/1959 Goldsmith ..... 428/383
3,862,353 A * 1/1975 Morton ..... 174/121 R
4,318,588 A 3/1982 Zeidler et al.
4,509,877 A 4/1985 Sobin et al.
2003/0066676 A1 4/2003 Stonikas et al.
2008/0277136 A1* 11/2008 Reyes ..... 174/110 R

FOREIGN PATENT DOCUMENTS

JP 01-319208 12/1989

OTHER PUBLICATIONS

Bibl et al., U.S. Appl. No. 12/637,509, filed Dec. 14, 2009.
Bibl et al., U.S. Appl. No. 12/637,355, filed Dec. 14, 2009.
Weber et al., U.S. Appl. No. 12/892,315, filed Sep. 28, 2010.

* cited by examiner

*Primary Examiner* — Brian Ensey
(74) *Attorney, Agent, or Firm* — Van Court & Aldridge LLP

(57) ABSTRACT

Fibers may be intertwined to form cables for headsets and other structures. The cables may include wires. The wires may be surrounded by a jacket formed from intertwined fibers. The intertwined fibers may include fibers with different melting temperatures. The jacket may be heated to a temperature that is sufficient to melt some of the fibers in the jacket without melting other fibers in the jacket. The melted fibers may flow into spaces between the unmelted fibers and may serve as a binder that holds together the unmelted fibers. The intertwining process may be used to form a bifurcation for a headset. A dipping process may be used to cover the jacket with a coating. The coating may be formed over the entire length of the cable or may be formed in a particular portion of the cable such as the portion of the cable that includes the bifurcation.

20 Claims, 4 Drawing Sheets

CABLES WITH INTERTWINED JACKETS

BACKGROUND

This invention relates to structures formed from intertwined fibers, and more particularly, to ways in which to form structures for electronic devices from intertwined fibers.

Electronic devices such as music players often use headsets. Some headsets are formed from wires that are contained within a cable having a fiber cable jacket. The use of fiber cable jackets may be more aesthetically pleasing than the use of uniform plastic cable jackets. Fiber cable jackets may, however, be subject to wear when exposed to the environment. If care is not taken, a fiber cable jacket may become soiled or may allow moisture to penetrate the interior of the cable.

It would therefore be desirable to be able to provide improved structures formed from intertwined fibers, such as improved headset cables for electronic devices.

SUMMARY

Cables for headsets and other structures may be formed from intertwined fibers (e.g., braided or interwoven fibers). The intertwined fibers may be formed by fiber intertwining equipment. The fiber intertwining equipment may braid or interweave the fibers to form a cable jacket that surrounds wires and a strengthening cord. The cable jacket may contain a bifurcation. Left and right speakers may be attached to the ends of the cable above the bifurcation. Below the bifurcation, the cable may be terminated in an audio jack.

The fibers that are intertwined to form the cable jacket may include polymer fibers, metal fibers, insulator-coated metal fibers, glass fibers, or other suitable fibers. The fibers that are intertwined may have different properties. For example, fibers with a first melting temperature may be intertwined with fibers with a second melting temperature that is greater than the first melting temperature. By raising the temperature of the jacket to a temperature that is between the first and second melting temperatures, the first fibers may be melted to form a binder that binds together the second fibers, which remain unmelted.

Other binders may also be incorporated into the fibers that make up the cable jacket. These binders may include epoxy and other thermoset materials, thermoplastic materials, etc.

Some or all of the cable jacket may be coated with a coating layer. The coating layer may be formed by dipping the jacket into a liquid such as a polymer precursor. To strengthen the cable jacket in the vicinity of the bifurcation, a segment of the cable jacket that includes the bifurcation may be dipped in the liquid coating material while remaining portions of the cable are exposed to air.

Further features of the invention, its nature and various advantages will be more apparent from the accompanying drawings and the following detailed description of the preferred embodiments.

DETAILED DESCRIPTION

Cables that are formed from jackets with intertwined fibers may be used in headphones, patch cords, power cords, or other equipment they conveys electrical signals. As an example, cables having jackets with intertwined fibers are sometimes described herein in the context of accessories such as headsets. This is, however, merely illustrative. Any suitable apparatus may be provided with a cable having a jacket formed from intertwined fibers if desired.

Figure 1:
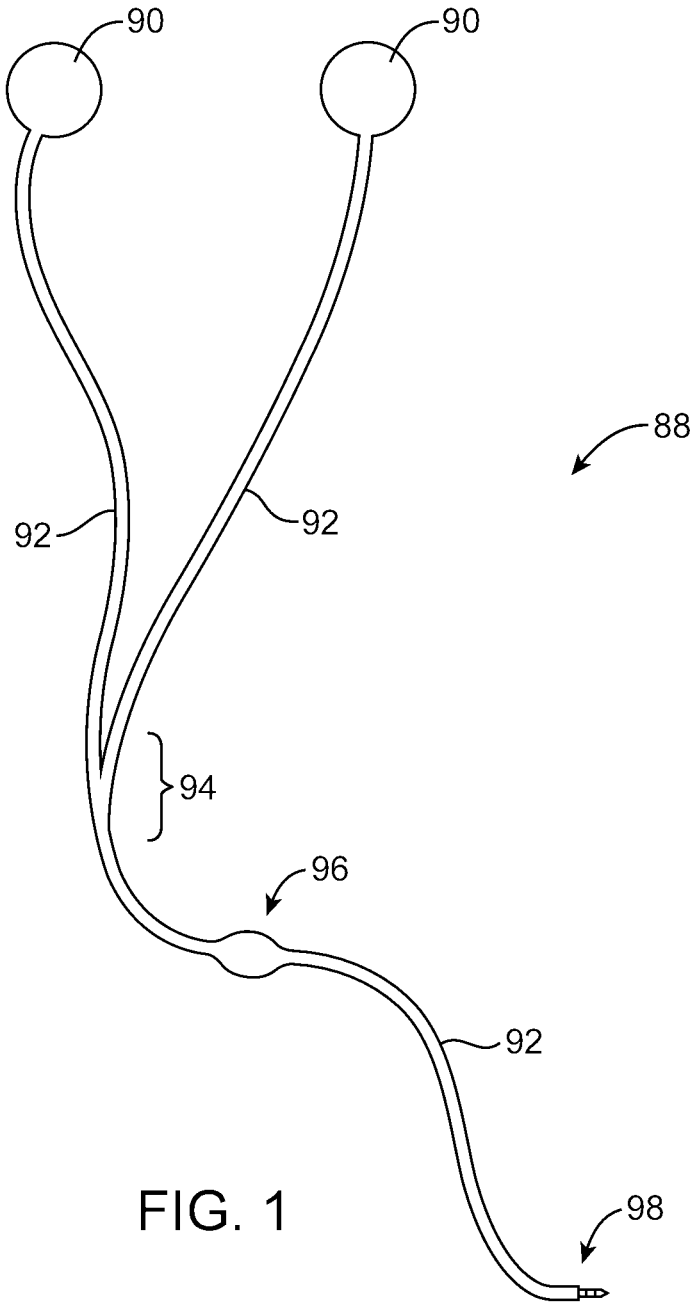
FIG. 1 is a perspective view of an illustrative accessory such as a headset that has been formed from intertwined fibers in accordance with an embodiment of the present invention.

An illustrative headset is shown in FIG. 1. As shown in FIG. 1, headset 88 may include a main cable portion 92. Cable 92 may be formed from intertwined fibers and may have portions formed from different types and amounts of fibers and different patterns and amounts of binder and coatings (as examples). Speakers 90 may be mounted at the ends of the right and left branches of cable 92. In region 94, cable 92 may have a bifurcation (forked region). Feature 96 may be an enclosure for a switch, microphone, etc. The end of cable 92 may be terminated by audio jack 98.

Figure 2:
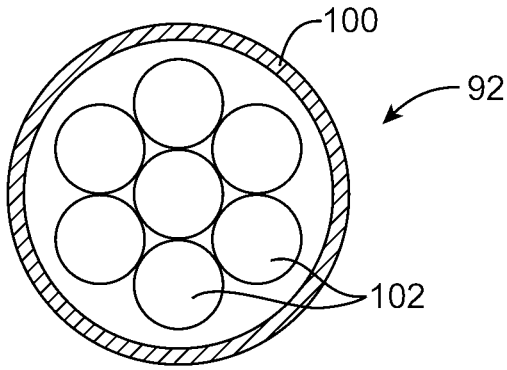
FIG. 2 is a cross-sectional view of a cable with a fiber jacket of the type that may be used in apparatus of the type shown in FIG. 1 in accordance with an embodiment of the present invention.

A cross-sectional view of cable 92 is shown in FIG. 2. As shown in FIG. 2, cable 92 may have a jacket such as jacket 100 (sometimes referred to as a sheath). Jacket 100 may enclose fibers such as fibers 102. Fibers 102 may include wires for conducting electrical signals. Wires may be used to carry power, digital signals, analog signals, etc. Wires may include stranded conductors or solid conductors. Wire insulation may be provided by dielectric coatings (e.g., polymer coatings). Fibers 102 may also include one or more strengthening cords (e.g., a cord formed from polymer fibers such as aramid fibers). Electromagnetic shielding structures (e.g., intertwined or wrapped foil conductive sheaths that surround bundles of wires within jacket 100) may also be included in cable 92.

Cable 92 may include any suitable number of wires (e.g., one or more). For example, cable 92 may include two wires (e.g., a positive wire and a negative wire). Cable 92 may also include three wires, four wires, five wires, six wires, or more than six wires. Arrangements with more wires may be used to handle additional audio channels (e.g., left and right speaker channels, surround sound channels, etc.). Arrangements with more wires may also be able to use two or more wires for conveying power (e.g., by forming a power path that is not used to handle any data signals or that handles only a minimal number of data signals). The incorporation of additional wires within cable 92 may also allow cable 92 to handle control signals (e.g., by providing a signal path for conveying signals from a controller in region 96 of headset 88 of FIG. 1 to connector 98).

Jacket 100 may include intertwined fibers, binder materials (sometimes referred to as matrix materials) such as epoxy or other binders that fill interstitial spaces between intertwined fibers, coatings, or other suitable structures. Optional layers such as electromagnetic sheaths, dielectric sheaths, and other layers may be interposed between jacket 100 and fibers 102 if desired.

Figure 3:
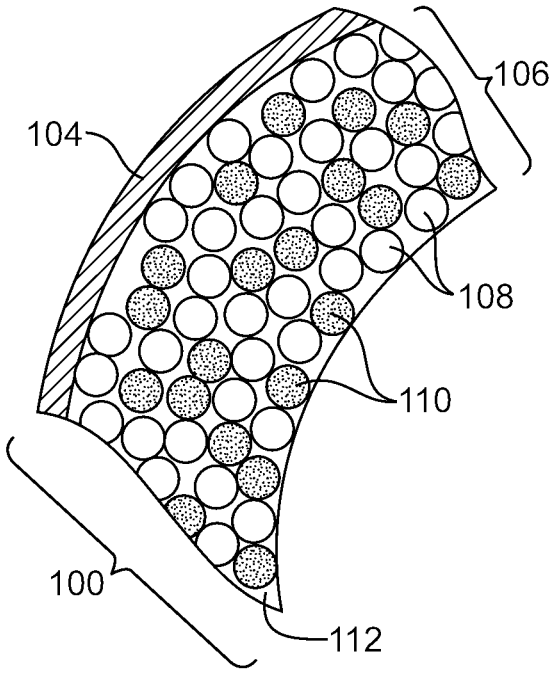
FIG. 3 is a cross-sectional view of a portion of a jacket formed from intertwined fibers in accordance with an embodiment of the present invention.

As shown in the illustrative cross-sectional view of jacket 100 of FIG. 3, jacket 100 may have a coating layer such as optional outer layer 104 and intertwined fibers 106. Layer 104 may be formed from polymer. Although shown as being formed on top of fibers 106 in FIG. 3, some of layer 104 may, if desired, penetrate into fibers 106. For example, layer 104 may be formed by dipping cable 92 into a liquid coating material. The liquid may impregnate some or all of fibers 106 and, when cured, may form dipped polymer coating 104. A layer such as layer 104 (i.e., an inner sheath layer) may also be formed beneath fibers 106.

Fibers 106 may be formed in one or more layers. Multiple layers of fibers 106 are shown in FIG. 3 as an example. Fibers 106 may be formed from any suitable materials. Examples of fibers 106 include metal fibers (e.g., strands of steel or copper), glass fibers (e.g., fiber-optic fibers that can internally convey light through total internal reflection), plastic fibers, etc. Some fibers may exhibit high strength (e.g., polymers such as aramid fibers). Other fibers such as nylon may offer good abrasion resistance (e.g., by exhibiting high performance on a Tabor test). Yet other fibers may be highly flexible (e.g., to stretch without exhibiting plastic deformation). Fibers may have different magnetic properties, different thermal properties, different melting points, different dielectric constants, different conductivities, different colors, etc.

Different fibers may melt (soften) at different temperatures. For example, fibers 106 may include two (or more) different types of fibers such as fibers 108 and 110 of FIG. 3. Fibers 108 may be formed from a first material such as nylon and fibers 110 may be formed from a second material such as polyethylene terephthalate (PET). In this type of arrangement fibers 108 may exhibit a lower melting point than fibers 110. For example, fibers 108 (e.g., nylon) may melt at a temperature in the range of about 100 to 120° C., whereas fibers 110 (e.g., PET) may melt at a temperature of 130° C. or more. When fibers 108 and 110 melt at different temperatures, the fibers that melt at the lower temperature may be melted to form a binder for the fibers that melt at the higher temperature.

Consider, as an illustrative example, a scenario in which fibers 108 have a melting temperature of 110° C. and fibers 110 have a melting temperature of 130° C. After fibers 108 and 110 have been intertwined using an intertwining tool, fibers 108 and 110 may be heated to an intermediate temperature such as 120° C. At this temperature, fibers 108 will melt and fibers 110 will not melt. Molten material from fibers 108 may therefore flow throughout fibers 110 and, when cooled, will form a binder that helps bind fibers 110 together. By binding fibers 110 together in this way, jacket 100 may be made resistant to the intrusion of moisture and dust.

If desired, other binders may be included in jacket 100. For example, binder 112 may be incorporated into the interstitial spaces between respective fibers 106. Binder 112 may be formed from epoxy or other suitable materials. These materials may sometimes be categorized as thermoset materials (e.g., materials such as epoxy that are formed from a resin that cannot be reflowed upon reheating) and thermoplastics (e.g., materials such as acrylonitrile butadiene styrene, polycarbonate, and ABS/PC blends that are reheatable). Both thermoset materials and thermoplastics and combinations of thermoset materials and thermoplastic materials may be used as binders if desired. When it is desired to include within fibers 106 at least some fibers 108 that melt to form a binder for unmelted fibers 110, fibers 108 may be formed from a thermoplastic material.

The fibers of cable 92 including jacket fibers 106 and interior fibers 102 (e.g., wires and strengthening cord) may be formed from metal, dielectric, or other suitable materials. The fibers of cable 92 may be relatively thin (e.g., less than 20 microns or less than 5 microns in diameter—i.e., carbon nanotubes or carbon fiber) or may be thicker (e.g., metal wire). The fibers of cable 92 may be formed from twisted bundles of smaller fibers (sometimes referred to as filaments) or may be formed as unitary fibers of a single untwisted material. Regardless of their individual makeup (i.e., whether thick, thin, or twisted or otherwise formed from smaller fibers), the strands of material that make up the wires, strengthening cords, and fibers in jacket 100 are referred to herein as fibers. In some contexts, the fibers of cable 92 may also be referred to as cords, threads, ropes, yarns, filaments, strings, twines, etc.

Figure 4:
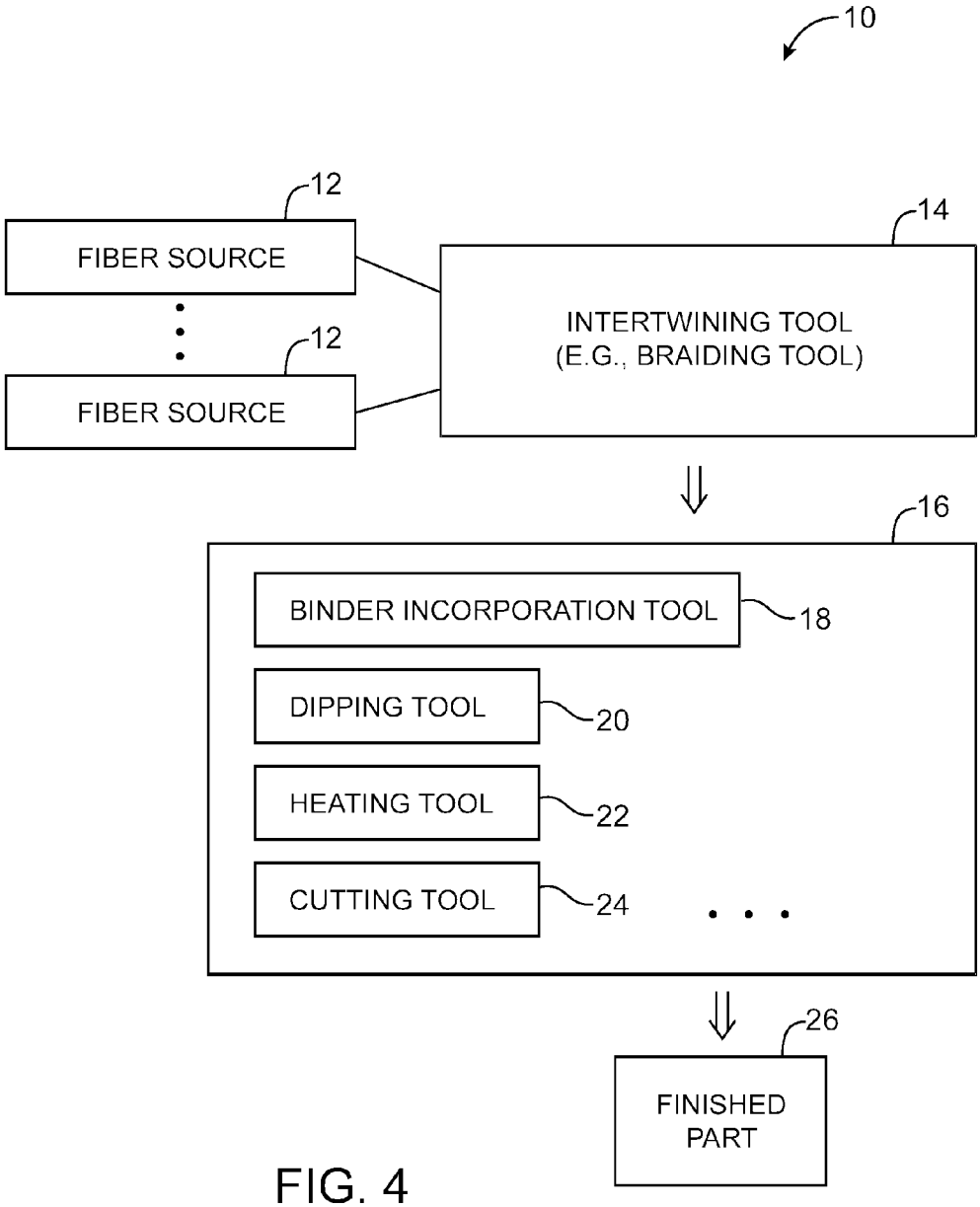
FIG. 4 is a schematic diagram of illustrative equipment that may be used in forming cables and associated devices in accordance with an embodiment of the present invention.

Fabrication equipment of the type that may be used to form headset 88 is shown in FIG. 4. As shown in FIG. 4, fabrication equipment 10 may be provided with fibers from fiber sources 12. Fiber sources 12 may provide fibers of any suitable type. Examples of fibers include metal fibers (e.g., strands of steel or copper with or without insulating coatings such as sheaths of plastic), glass fibers (e.g., fiber-optic fibers that can internally convey light through total internal reflection), plastic fibers, etc.

Intertwining tool(s) 14 may be based on any suitable fiber intertwining technology. For example, intertwining equipment 14 may include computer-controlled intertwining tools (e.g., braiding tools or weaving tools). Equipment 14 may be used to form tubular interwoven or braided structures such as jacket 100 surrounding wires and one or more strengthening cords (see, e.g., fibers 102 of FIG. 2). Seamless bifurcations (see, e.g., bifurcation 94 of FIG. 1) may be formed in a tubular jacket using equipment 14. In this type of configuration, some of wires 102 will follow the left-hand branch of cable 92 and some of the wires will follow the right-hand branch of cable 92 above bifurcation 94. Between bifurcation 94 and connector 98, all of fibers 102 may be surrounded by a single jacket. Tool 14 may form the portion of the jacket that lies between connector 98 and bifurcation 94 from 32 fibers (as an example). Above bifurcation 94, 16 of the 32 fibers may be intertwined to form the jacket for the left-hand branch of cable 92 and 16 of the 32 fibers may be intertwined to form the jacket for the right-hand branch of cable 92.

Tools 16 may be used to process cable 92 after jacket 100 has been formed around fibers 102. Tools 16 may include tools 18 such as molds, spraying equipment, and other suitable equipment for incorporating binder into portions of the intertwined fibers produced by intertwining equipment 14. Tools 16 may also include dipping tools such as tool 20 for forming coatings such as coating 104 of FIG. 3. Coating 104 may, for example, be formed by dipping jacket 100 into a binder such as a liquid polymer. Heating tools such as heating tool 22 may be used to apply heat to cable 92 (e.g., to melt, dry, or cure a binder, to melt fibers such as fibers 108 in jacket 100, etc.). Heating tool 22 may be implemented using an oven, a heat lamp (e.g., an infrared lamp), a laser heating tool, a hot plate, a heated mold, or other heating equipment. An ultraviolet (UV) lamp may be included in tools 16 for UV curing operations. Cutting tool 24 may include blades or other cutting equipment for dividing jacket 100 and fibers 102 into desired lengths for forming cable 92 for accessory 88. The tools of equipment 16 may be controlled by computers or other suitable control equipment. If desired, additional tools may be included in equipment 16. The examples of FIG. 4 are merely illustrative.

Equipment in system 10 such as intertwining tool 14 and equipment 16 may be used to form finished parts such as finished part 26 (e.g., cable 92 for headset 88 of FIG. 1) or other structures from fibers provided from fiber sources 12.

Tools 16 may, if desired, include computer-controlled equipment and/or manually operated equipment that can selectively incorporate binder into different portions of a workpiece in different amounts. For example, when it is desired to stiffen a fiber structure, more resin can be incorporated into the intertwined fiber, whereas less resin can be incorporated into the intertwined fiber when a flexible structure is being formed. Different portions of the same structure can be formed with different flexibilities in this way. Following curing (e.g., using heat or ultraviolet light, the binder will stiffen and harden). The resulting structure (finished part 26) can be used in a computer structure, a structure for other electrical equipment, headset 88, etc.

Figure 5:
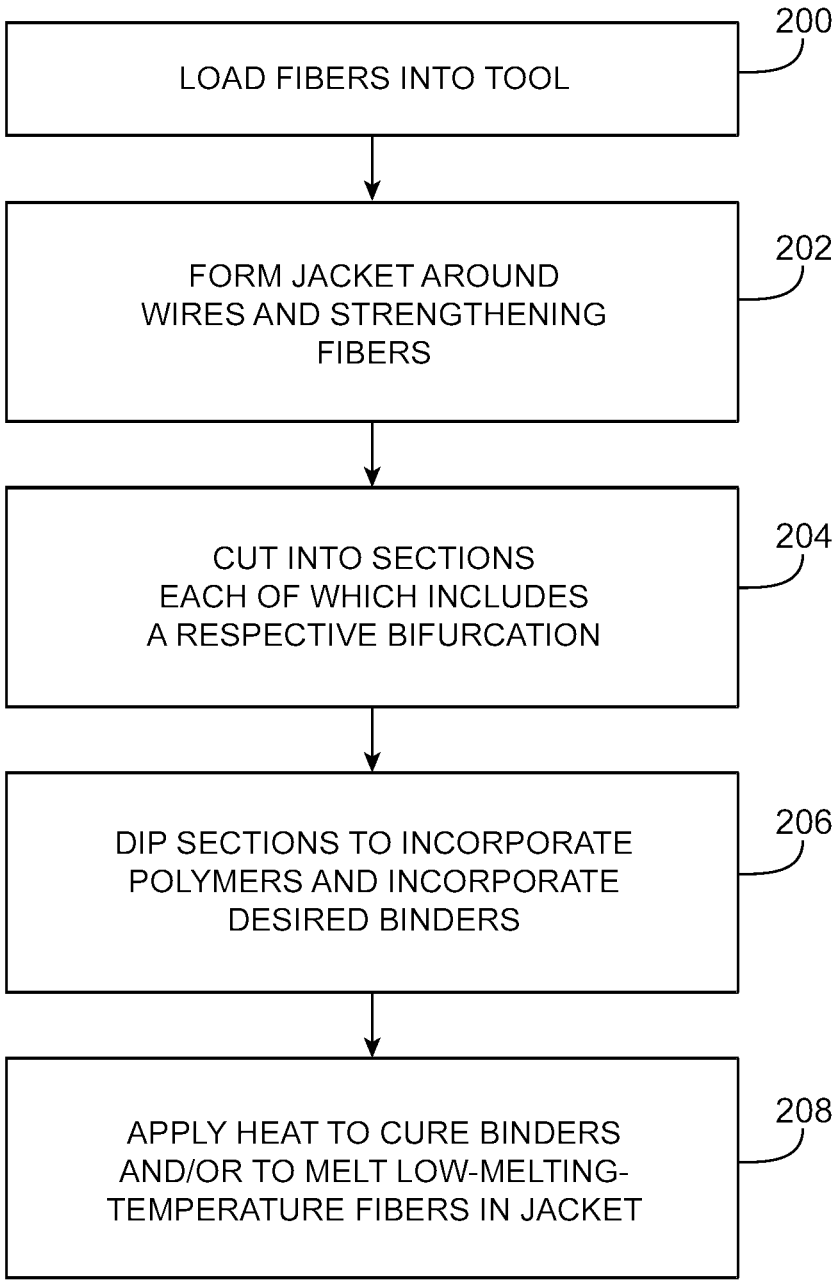
FIG. 5 is a flow chart of illustrative steps involved in forming structures based on intertwined fibers using equipment of the type shown in FIG. 4 in accordance with an embodiment of the present invention.

Illustrative steps involved in using equipment of the type shown in FIG. 4 to form cable 92 and other such structures is shown in FIG. 5.

At step 200 fibers such as fibers 102 for the interior of cable 92 and fibers such as fibers 106 for cable jacket 100 may be loaded into fiber sources 12.

At step 202, tool 14 may be used to form jacket 100 around fibers 102, as shown in FIG. 2. Fibers 102 may include metal wires (e.g., insulated or uninsulated wires of stranded and/or solid copper) and one or more strengthening cords. Cable components such as shielding layers may be formed around fibers 102 (e.g., before feeding fibers 102 into the intertwining tool). Tool 14 may braid, interweave, or otherwise intertwine fibers 106 around fibers 102. As shown in FIG. 3, fibers 106 may include one or more different types of fiber (e.g., a low melting temperature fiber 108 and a high melting temperature fiber 110 and/or other fibers).

During the operations of steps such as steps 204, 206, and 208, cable 92 may be completed using tools 16. During these steps, tool 18 may incorporate binder into the fibers, tool 20 may be used to dip the cable into a liquid, heating tool 22 may apply heat, cutting tool 24 may make cuts, etc. Any suitable order may be used in performing these steps.

In the example of FIG. 5, cutting tool 24 may be used to cut the cable into sections each of which includes a respective bifurcation 94 during the operations of step 204.

Following the operations of step 204, tool 20 may, at step 206, be used incorporated polymers and other suitable materials into the fibers. For example, thermoset and/or thermoplastic binders may be incorporated into the fibers of cable 92. Tool 20 may, if desired, be used to dip the cable or a selected segment of the cable into a liquid (e.g., a polymer precursor for forming coating 104). When dipped into the liquid, the liquid may flow into the spaces between fibers 106 (e.g., to form coating 104). The liquid may be cured by heat or by application of UV light or may be cured at room temperature (e.g., when the liquid is formed from a mixed two-part epoxy), etc.

Precursors for coating 104 may also be formed by spraying, by placing the cable in a chamber containing a vapor of precursor material, using multiple applications of coating chemicals, etc. Coating 104 may be formed from a flexible substance to help preserve the flexibility of cable 92, a substance that helps strengthen the portion of the cable that is coated with coating 104, or substances with other desirable properties (e.g., to adjust the color of cable 92, to adjust the soil-repelling nature of cable 92, to adjust the ability of cable 92 to withstand wear, or to change other properties of cable 92).

Coating 104 may help prevent dirt and moisture from entering the spaces between fibers 106 and may help prevent fibers 106 from unwinding. This may help preserve the appearance of cable 92. If, for example, cable 92 is formed from white fibers, the formation of coating 104 over and/or between the white fibers may help prevent dark pieces of dirt from becoming lodged between the white fibers. Coating 104 may therefore prevent cable 92 from becoming soiled and appearing dirty. To help repel dirt, coating 104 may be formed from a dirt-repelling substance (e.g., a fluorosurfactant). Other illustrative materials that may be used to form coating 104 include parylene or other oleophobic materials, fluorine-based materials, silicone, acrylic-based materials, etc.

Coating 104 may be formed over substantially all of cable 92 (e.g., over the entire cable length shown in FIG. 1) or may be formed on part of cable 92. For example, coating 104 may be formed over a portion of cable 92 in the vicinity of bifurcation 94 (e.g., within a segment of 1-8 cm in length, within a segment of less than 1 cm in length, or within a segment of less than 4 cm in length that is centered over bifurcation 94). A segment of coating 104 may be formed, for example, by dipping only bifurcation 94 of cable 92 into the coating liquid, while leaving remaining portions of cable 92 exposed to air. This type of arrangement may be used to provide localized strength enhancement to the portion of cable 92 that includes bifurcation 94, without unnecessarily decreasing the flexibility of the remaining portions of cable 92.

Heat may be applied to cable 92 at step 208 to cure materials that were incorporated into the fibers of the cable during the operations of step 204. For example, heat may be applied to cure an epoxy binder or other thermoset binder that was incorporated into cable fibers. Heat may also be applied to melt a thermoplastic binder. For example, heat may be applied at step 208 to melt at least some of fibers 108 so that they flow into the spaces between unmelted fibers 110 as described in connection with FIG. 3. The process of melting and resolidifying fibers 108 may form a binder throughout fibers 106 (e.g., to form coating 104 and/or to form binder in internal locations such as interstitial binder locations 112 of FIG. 3). The presence of melted fibers 108, coating 104, binder 112, or other materials between fibers 106 may help prevent dirt and moisture from entering cable 92.

The order of the cable fabrication operations shown in FIG. 5 is merely illustrative. If desired, step 208 may be performed before steps 204 and/or 206, step 206 may be performed before step 204, other steps may be performed in forming cable 92 and accessory 88, some or all of these steps may be performed simultaneously, etc.

The foregoing is merely illustrative of the principles of this invention and various modifications can be made by those skilled in the art without departing from the scope and spirit of the invention.

What is claimed is:

1. Headphones, comprising:

a fiber-based cable comprising:

a first plurality of fibers intertwined with a second plurality of fibers; and a coating disposed over the first plurality of fibers, wherein the coating is at least partially formed from at least one melted portion of the second plurality of fibers.

2. The headphones defined in claim 1 wherein the coating at least partially comprises a polymer.

3. Headphones, comprising:

a fiber-based cable; and speakers, wherein the fiber-based cable includes a coating, wherein the coating comprises a polymer, wherein the fiber-based cable includes first fibers and second fibers, wherein the first fibers have a melting point lower than the second fibers, and wherein the coating is formed at least partly from melted portions of the first fiber.

4. The headphones defined in claim 3 wherein the first fibers comprise nylon.

5. The headphones defined in claim 4 wherein the second fibers comprise polyethylene terephthalate.

6. The headphones defined in claim 1 wherein each fiber of the first plurality of fibers comprises nylon and each fiber of the second plurality of fibers comprises polyethylene terephthalate.

7. The headphones defined in claim 1 wherein the coating at least partially comprises a dipped polymer coating.

8. Apparatus, comprising:

wires; and intertwined fibers that form a jacket that surrounds the wires to form a cable, wherein the intertwined fibers include first fibers and second fibers, wherein the first fibers have a first melting temperature, wherein the second fibers have a second melting temperature, and wherein the jacket includes at least some melted portions of the first fibers in spaces between unmelted portions of the second fibers.

9. The apparatus defined in claim 8 wherein the first fibers include nylon fibers.

10. The apparatus defined in claim 8 wherein the second fibers include polyethylene terephthalate fibers.

11. The apparatus defined in claim 8 further comprising a dipped polymer coating on the jacket.

12. The apparatus defined in claim 8 further comprising a connector.

13. The apparatus defined in claim 12 wherein the connector comprises an audio jack.

14. The apparatus defined in claim 8 wherein the intertwined fibers comprise braided fibers.

15. The apparatus defined in claim 14 wherein the jacket comprises a bifurcation.

16. The apparatus defined in claim 15 further comprising a pair of speakers connected to the wires and an audio jack connected to the wires.

17. The headphones defined in claim 1, wherein:

each fiber of the first plurality of fibers comprises a first melting point; and each fiber of the second plurality of fibers comprises a second melting point that is different from the first melting point.

18. The headphones defined in claim 1, wherein the headphones further comprises at least one audio component coupled to a portion of the fiber-based cable.

19. The headphones defined in claim 18, wherein the at least one audio component comprises at least one of a speaker and an audio jack.

20. The headphones defined in claim 1 further comprising at least one conductor disposed within the fiber-based cable.

* * * * *